US008297071B2

(12) United States Patent
Shioyama et al.

(10) Patent No.: US 8,297,071 B2
(45) Date of Patent: Oct. 30, 2012

(54) SHUT-OFF VALVE MOUNTING STRUCTURE, AND OUTDOOR UNIT OF AIR CONDITIONER INCLUDING THE SAME

(75) Inventors: Kazuhiro Shioyama, Sakai (JP); Satoru Ohkura, Sakai (JP); Tadashi Sao, Sakai (JP); Ikuji Ishii, Sakai (JP); Keiji Ishida, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1231 days.

(21) Appl. No.: 12/090,504

(22) PCT Filed: Oct. 27, 2006

(86) PCT No.: PCT/JP2006/321510

§ 371 (c)(1),
(2), (4) Date: Apr. 17, 2008

(87) PCT Pub. No.: WO2007/052556

PCT Pub. Date: May 10, 2007

(65) Prior Publication Data

US 2009/0260391 A1 Oct. 22, 2009

(30) Foreign Application Priority Data

Nov. 1, 2005 (JP) ..... 2005-318921
Feb. 17, 2006 (JP) ..... 2006-041210

(51) Int. Cl.
*F25D 19/00* (2006.01)
*F25B 41/06* (2006.01)

(52) U.S. Cl. ..... 62/299; 62/298; 62/527

(58) Field of Classification Search ..... 62/289, 62/299, 298, 527

See application file for complete search history.

(56) References Cited

U.S. PATENT DOCUMENTS

| | | | | |
|---|---|---|---|---|
| 4,748,827 | A * | 6/1988 | Chang | 62/272 |
| 6,094,928 | A * | 8/2000 | Oyabu et al. | 62/259.1 |
| 2005/0150247 | A1 * | 7/2005 | Ishihara et al. | 62/507 |

FOREIGN PATENT DOCUMENTS

| | | | |
|---|---|---|---|
| JP | 05-203196 | * | 1/1992 |
| JP | 04-95229 U | | 8/1992 |
| JP | 05-52633 U | | 7/1993 |
| JP | 2001-263734 A | | 9/2001 |
| JP | 2002-054823 A | | 2/2002 |
| JP | 2003-269750 A | | 9/2003 |
| JP | 2004-037007 A | | 2/2004 |
| WO | WO2004005805 | * | 1/2004 |

* cited by examiner

*Primary Examiner* — Frantz Jules
*Assistant Examiner* — Cassey D Bauer
(74) *Attorney, Agent, or Firm* — Global IP Counselors

(57) ABSTRACT

A shut-off valve mounting structure is for holding shut-off valves in place in an outdoor unit of an air conditioner, and includes bases, and a fixing portion. The shut-off valves are connected to an indoor unit of the air conditioner via refrigerant communication pipes. The bases extend upwards from a bottom frame of the outdoor unit (2). The fixing portion is continuous with the bases, and holds the shut-off valves in place such that a space exists below the shut-off valves.

3 Claims, 9 Drawing Sheets

SHUT-OFF VALVE MOUNTING STRUCTURE, AND OUTDOOR UNIT OF AIR CONDITIONER INCLUDING THE SAME

TECHNICAL FIELD

CROSS-REFERENCE TO RELATED APPLICATIONS

This U.S. National stage application claims priority under 35 U.S.C. §119(a) to Japanese Patent Application Nos. 2005-318921, filed in Japan on Nov. 1, 2005, and 2006-041210, filed in Japan on Feb. 17, 2006, the entire contents of which are hereby incorporated herein by reference.

The present invention relates to a shut-off valve mounting structure for fixing a shut-off valve in an outdoor unit of an air conditioner, and an outdoor unit of an air conditioner having the same.

BACKGROUND ART

Among the air conditioning systems used in office buildings and residential buildings, separate type systems having an indoor unit and an outdoor unit connected by refrigerant communication pipes are widely used. For example, in the multi separate type air conditioning system used in office buildings and other buildings, the outdoor unit is installed on the roof or other location and the indoor units are installed in the ceiling or other location of each floor, the outdoor unit and indoor units being connected together by a gas-side refrigerant communication pipe and a liquid-side refrigerant communication pipe to form a refrigerant circuit.

The outdoor unit of such an air conditioning system has a gas-side shut-off valve and a liquid-side shut-off valve, which are at the terminal ends of the part included in the outdoor unit of the refrigerant circuit. These shut-off valves are connected to the gaseous refrigerant communication pipe and liquid refrigerant communication pipe extended from the indoor units and switched from the closed state to the opened state after the outdoor unit and the indoor units have been installed onsite. As a result, refrigerant can flow between the outdoor unit and the indoor units.

Meanwhile, Japanese Patent Laid-Open Publication No. 2004-37007 shows a structure in which the gas-side shut-off valve and the liquid-side shut-off valve in a conventional outdoor unit are held in place by a mounting panel standing on the bottom frame of the outdoor unit. Although this kind of a mounting panel is not shown clearly in the drawings of Patent Japanese Patent Laid-Open Publication No. 2004-37007, often times it is shaped basically like the mounting panel 100 shown in FIG. 9. The mounting panel 100 has a shape which is formed by bending a plate-like member into an L-letter shape, and the portion 101 being bent is in surface contact with the bottom frame of the outdoor unit, while the other portion 102 has incisions 102*a* and 102*b* formed thereon for inserting the shut-off valves.

SUMMARY OF THE INVENTION

Object to be Achieved by the Present Invention

However, if the shut-off valves are fixed to this kind of a mounting panel, the bonding between the shut-off valves and the refrigerant communication pipes may be difficult. For example, if the bonding between the shut-off valves and the refrigerant communication pipes is done by brazing (bonding a metal to another metal by heat using a brazing filler metal), there is the danger of the flame from a burner and the like being applied to not only the bonding portion but also the mounting panel. Furthermore, the working space is limited due to the space in the vicinity of the mounting panel being blocked off. As a result, the movement of the hands of those performing the bonding operation and the movable angle of the tools are limited, which causes inconvenience more or less for those conducting the bonding operation.

An object of the present invention is to improve the workability of the bonding operation of a shut-off valve and a refrigerant communication pipe in an outdoor unit of an air conditioner.

Means to Achieve the Object

According to a first aspect of the present invention, a shut-off valve mounting structure is for holding a shut-off valve in place in an outdoor unit of an air conditioner, and includes a base and a fixing portion. The shut-off valve is connected to an indoor unit of the air conditioner via a refrigerant communication pipe. The base extends upwards from a bottom frame of the outdoor unit. The fixing portion is continuous with the base, and holds the shut-off valve in place. A space exists below the shut-off valve being held in place in the fixing portion.

With this shut-off valve mounting structure, the fixing portion being continuous with the base extending upwards from the bottom frame of the outdoor unit of the air conditioner holds the shut-off valve in place. And, below the shut-off valve being held in place in the fixing portion, that is, below a portion of the fixing portion where the shut-off valve is held in place, the base does not exist and a space stretches out across. That is, this shut-off valve mounting structure is mainly made up of the column shaped base standing on the bottom frame of the outdoor unit, and the beam-like fixing portion supported by the base. Furthermore, the base and the fixing portion may be formed integrally, or may be separate bodies.

Meanwhile, when installing the outdoor unit of the air conditioner onsite, it is necessary to connect the shut-off valve to the refrigerant communication pipe that connects to the indoor unit. At this time, for example, like it is done conventionally, if the shut-off valve mounting structure is shaped from one sheet of a generally rectangular plate-like member, the flame from a burner and the like may accidentally burn the shut-off valve mounting structure on a place other than where brazing is to be done, and also, the shut-off valve mounting structure itself divides off a space, which limits the working space. On the other hand, in an outdoor unit in which the shut-off valve mounting structure according to the first aspect of the present invention is adopted, since an open space is formed below the shut-off valve, this kind of a problem may be solved.

With this shut-off valve mounting structure, the workability of connecting the shut-off valve and the refrigerant communication pipe is increased this way, in the outdoor unit of the air conditioner.

According to a second aspect of the present invention, the shut-off valve mounting structure of the first aspect of the present invention is provided, wherein the base is formed from two column shaped members. The fixing portion is continuous with both the two column shaped members.

With this shut-off valve mounting structure, the beam-like fixing portion is continuous with the two column shaped members. That is, this shut-off valve mounting structure has a structure in a gate-like shape as a whole. Thus, with this shut-off valve mounting structure, an open space is formed below the shut-off valve, which increases the workability of connecting the shut-off valve and the refrigerant communication pipe, and also, the overall strength can be improved.

According to a third aspect of the present invention, the shut-off valve mounting structure of the first or second aspect of the present invention is provided, wherein the base and the fixing portion can be separated.

Normally, the number and the size of shut-off valves mounted in an outdoor unit of an air conditioner differ due to the difference in the horsepower of the air conditioner, whether or not the air conditioner is a cooling/heating free air conditioner, and so forth. Therefore, the shape of the shut-off valve mounting structure used also differs with the difference in the model of the air conditioner.

On the other hand, with the shut-off valve mounting structure in accordance with the third aspect of the present invention, the column shaped base and the beam-like fixing portion are separate bodies, and can be separated. As a result, when developing new models of air conditioners, the base can be used without being changed, while only the fixing portion can be newly designed and modified.

According to a fourth aspect of the present invention, the shut-off valve mounting structure of any of the first to the third aspects of the present invention is provided, wherein the bottom frame has a protrusion protruding inward inside the outdoor unit. The base includes an engaging portion. The engaging portion engages with at least a portion of the outline of the protrusion.

With this shut-off valve mounting structure, a specific portion (engaging portion) of the base is configured to engage with at least a portion of the protrusion provided on the bottom frame. For this reason, the positioning of this shut-off valve mounting structure on the bottom frame of the outdoor unit becomes easy, and also, the shut-off valve mounting structure can be fixed stronger to the bottom frame.

According to a fifth aspect of the present invention, an outdoor unit of an air conditioner includes a casing, a shut-off valve, and a shut-off valve mounting structure. The casing includes a bottom frame. The shut-off valve is connected to an indoor unit via a refrigerant communication pipe. The shut-off valve mounting structure is for holding the shut-off valve in place. The shut-off valve mounting structure includes a base and a fixing portion. The base extends upwards from the bottom frame. The fixing portion is continuous with the base and holds the shut-off valve in place. And, a space exists below the shut-off valve.

With this outdoor unit, the shut-off valve is held in place by the shut-off valve mounting structure. The fixing portion being continuous with the base that extends upwards from the bottom frame of the outdoor unit holds the shut-off valve in place in this shut-off valve mounting structure. And, below the shut-off valve being held in place in the fixing portion, that is, below a portion of the fixing portion where the shut-off valve is held in place, the base does not exist, and a space stretches out across. That is, this shut-off valve mounting structure is mainly made up of the column shaped base standing on the bottom frame of the outdoor unit, and the beam-like fixing portion supported by the base. In addition, the base and the fixing portion may be formed integrally, or may be separate bodies.

Meanwhile, when installing the outdoor unit of the air conditioner onsite, it is necessary to connect the shut-off valve to the refrigerant communication pipe that connects to the indoor unit. At this time, for example, like it is done conventionally, if the shut-off valve mounting structure is shaped from one sheet of a generally rectangular plate-like member, the flame from a burner and the like may accidentally burn the shut-off valve mounting structure on a place other than where brazing is to be done, and also, the shut-off valve mounting structure itself divides off a space, which limits the working space. On the other hand, in the outdoor unit in accordance with the fifth aspect of the present invention, since an open space is formed below the shut-off valve, this kind of a problem may be solved.

With this outdoor unit, the workability of connecting the shut-off valve and the refrigerant communication pipe is increased this way.

According to a sixth aspect of the present invention, the outdoor unit of the air conditioner of the fifth aspect of the present invention is provided, wherein the shut-off valve includes a gas-side shut-off valve and a liquid-side shut-off valve. The gas-side shut-off valve and the liquid-side shut-off valve are offset in the depth direction so that the gas-side shut-off valve is positioned more to the front side than the liquid-side shut-off valve when viewed in plan.

With this outdoor unit, the gas-side shut-off valve and the liquid-side shut-off valve are held in place by the shut-off valve mounting structure. The gas-side shut-off valve is being offset to the front side of the outdoor unit from the liquid-side shut-off valve. With this outdoor unit, since the gas-side shut-off valve, which closes off a pipe that is thicker than a pipe the liquid-side shut-off valve closes off, is arranged in closer position than the liquid-side shut-off valve to the front side, the workability of connecting the shut-off valve and the refrigerant communication pipe is even increased.

Effect of the Present Invention

With the shut-off valve mounting structure in accordance with the first aspect of the present invention, the fixing portion being continuous with the base extending upwards from the bottom frame of the outdoor unit of the air conditioner holds the shut-off valve in place. There is a space below the shut-off valve held in place in the fixing portion, that is, below a portion of the fixing portion where the shut-off valve is held in place. That is, this shut-off valve mounting structure is mainly made up of the column shaped base standing on the bottom frame of the outdoor unit, and the beam-like fixing portion supported by the base. With this shut-off valve mounting structure, since an open space is formed below the shut-off valve this way, the workability of connecting the shut-off valve and the refrigerant communication pipe in the outdoor unit of the air conditioner is increased.

With the shut-off valve mounting structure in accordance with the second aspect of the present invention, the beam-like fixing portion is continuous with the two column shaped members. That is, this shut-off valve mounting structure has a structure in a gate-like shape as a whole. Thus, with this shut-off valve mounting structure, an open space is formed below the shut-off valve, which increases the workability of connecting the shut-off valve and the refrigerant communication pipe, and also, the overall strength can be improved.

With the shut-off valve mounting structure in accordance with the third aspect of the present invention, the column shaped base and the beam-like fixing portion are separate bodies, and can be separated. As a result, when developing new models of air conditioners, the base can be used without being changed, while only the fixing portion can be newly designed and modified.

With the shut-off valve mounting structure in accordance with the fourth aspect of the present invention, a specific portion (engaging portion) of the base is configured to engage with at least a portion of the protrusion provided on the bottom frame. For this reason, with this shut-off valve mounting structure, the positioning of this shut-off valve mounting structure on the bottom frame of the outdoor unit becomes easy, and also, the shut-off valve mounting structure can be fixed stronger to the bottom frame.

With the outdoor unit of the air conditioner in accordance with the fifth aspect of the present invention, the shut-off valve is held in place by the shut-off valve mounting structure. The fixing portion being continuous with the base that extends upwards from the bottom frame of the outdoor unit holds the shut-off valve in place in this shut-off valve mounting structure. And, there is a space below the shut-off valve being held in place in the fixing portion, that is, below a portion of the fixing portion where the shut-off valve are held in place. That is, this shut-off valve mounting structure is mainly made up of the column shaped base standing on the bottom frame of the outdoor unit, and the beam-like fixing portion supported by the base. In this manner, since an open space is formed below the shut-off valve in this outdoor unit, the workability of connecting the shut-off valve and the refrigerant communication pipe is increased.

With the outdoor unit of the air conditioner in accordance with the sixth aspect of the present invention, the gas-side shut-off valve and the liquid-side shut-off valve are held in place by the shut-off valve mounting structure. The gas-side shut-off valve is being offset to the front side of the outdoor unit from the liquid-side shut-off valve. With this outdoor unit, since the gas-side shut-off valve, which closes off a pipe that is thicker than a pipe the liquid-side shut-off valve closes off, is arranged in closer position than the liquid-side shut-off valve to the front side in this manner, the workability of connecting the shut-off valve and the refrigerant communication pipe is increased.

DETAILED DESCRIPTION OF THE INVENTION

<Constituent Features of the Air Conditioner>

Figure 1:
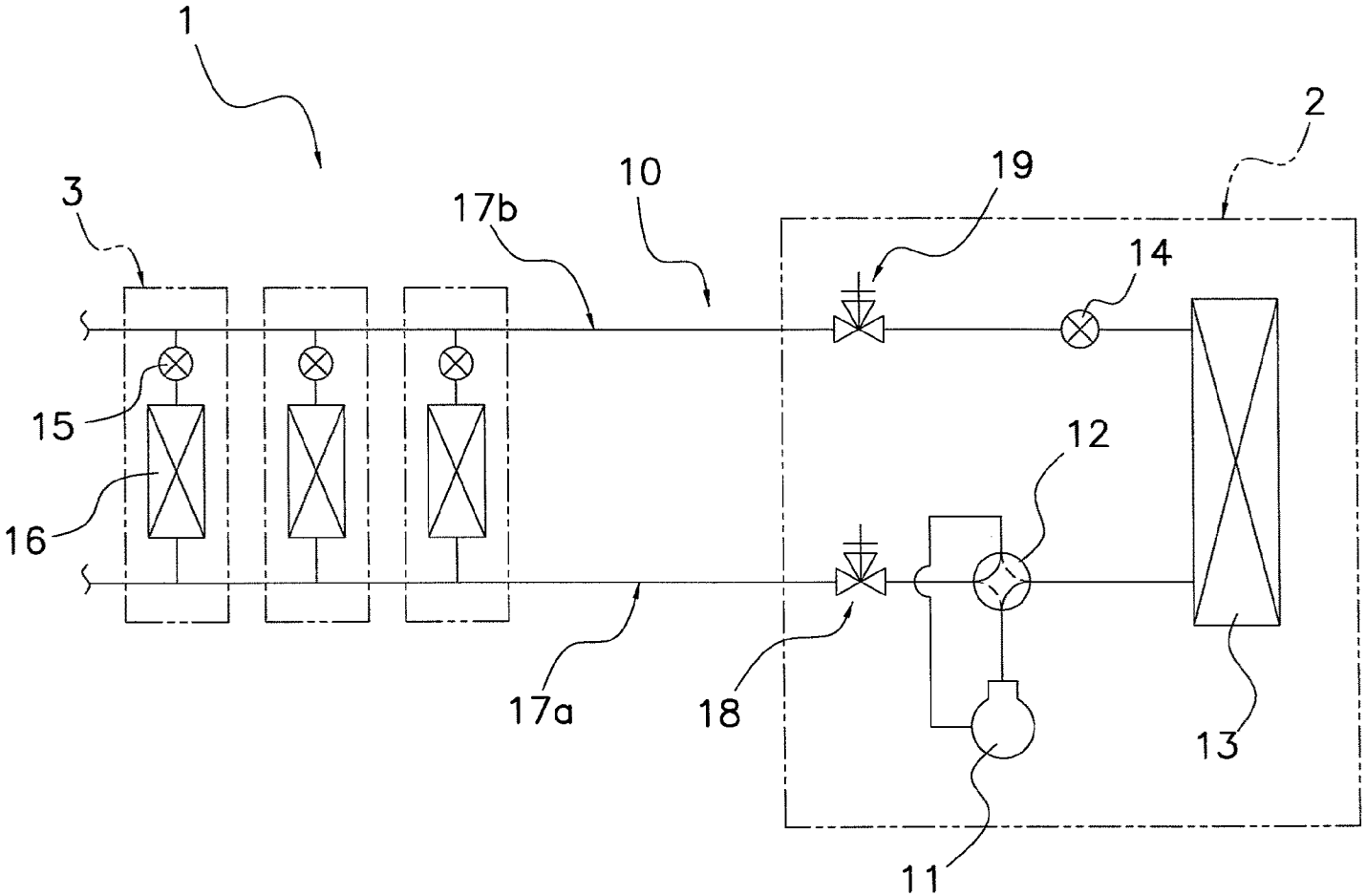
FIG. 1 is a refrigerant circuit diagram of an air conditioner that includes an outdoor unit in accordance with an embodiment of the present invention.

FIG. 1 shows a refrigerant circuit 10 of an air conditioner 1 including an outdoor unit 2 in accordance with an embodiment of the present invention. The air conditioner 1 is a multiple-type air conditioner for office buildings and other buildings having one or a plurality of outdoor unit(s) 2 and a plurality of indoor units 3 connected in parallel to the outdoor unit(s) 2. The refrigerant circuit 10 of the air conditioner 1 mainly includes a compressor 11, a four-way selector valve 12, an outdoor heat exchanger 13, an outdoor expansion valve 14, indoor expansion valves 15, and indoor heat exchangers 16 connected in sequence and is configured to perform a vapor compression type refrigeration cycle.

The compressor 11, four-way selector valve 12, outdoor heat exchanger 13, and outdoor expansion valve 14 are contained in the outdoor unit 2 and the indoor expansion valves 15 and indoor heat exchangers 16 are contained in the indoor units 3. In addition, the four-way selector valve 12 and the indoor heat exchangers 16 are connected by a gas-side refrigerant communication pipe 17*a* and the outdoor expansion valve 14 and the indoor expansion valves 15 are connected by a liquid-side refrigerant communication pipe 17*b*. The refrigerant communication pipes 17*a*, 17*b* are arranged between the outdoor unit 2 and the indoor units 3. Furthermore, an accumulator and other associated devices are also provided inside the outdoor unit 2, but are omitted here in the drawing.

The terminal portions of the refrigerant circuit inside the outdoor unit 2 are provided with a gas-side shut-off valve 18 and a liquid-side shut-off valve 19. The gas-side shut-off valve 18 is arranged on the side of the four-way selector valve 12, and the liquid-side shut-off valve 19 is arranged on the side of the outdoor expansion valve 14. The gas-side shut-off valve 18 is connected to the gas-side refrigerant communication pipe 17*a* and the liquid-side shut-off valve 19 is connected to the liquid-side refrigerant communication pipe 17*b*. The shut-off valves 18, 19 are in the closed state when the outdoor unit 2 and the indoor units 3 are being installed. And, the shut-off valves 18, 19 are opened after the units 2, 3 are each installed onsite and the gas-side refrigerant communication pipe 17*a* and the liquid-side refrigerant communication pipe 17*b* are connected to the shut-off valves 18, 19.

The refrigerant circuit 10 of the air conditioner 1 shown in FIG. 1 is a simplification of the actual circuit. For example, the actual compressor 11 is often a combination of one or more variable capacity compressor(s) (hereinafter, inverter compressor(s)) whose rotational speed(s) can be controlled with an inverter and one or more fixed capacity compressor(s) (hereinafter, fixed capacity compressor(s)) controlled in an on-off manner, so that it can have various horsepower of 5, 8, 10, 12, 14, 16, 18 horsepower (HP) to correspond to the size of the building in which it will be installed. Furthermore, the compressor 11 in the description of this embodiment is a combination of an inverter compressor 11*a* and a fixed capacity compressor 11*b* (refer to FIG. 4).

Figure 2:
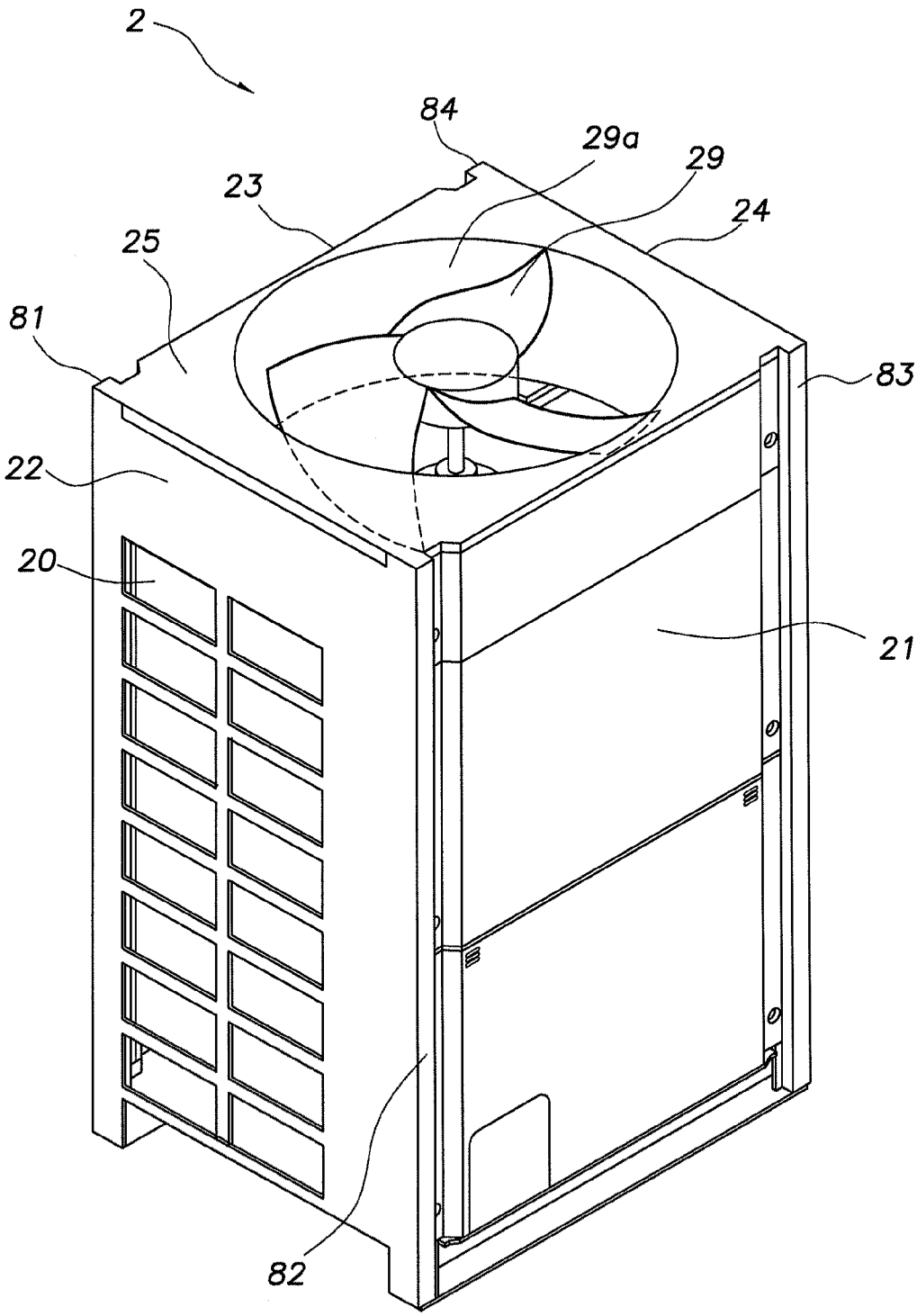
FIG. 2 is an appearance diagram of the outdoor unit.

In addition, an outdoor fan 29 blowing air to the outdoor heat exchanger 13 for accelerating heat exchange between refrigerant and air is provided in the outdoor unit 2 (refer to FIG. 2).

<Operation of the Air Conditioner>

Next, the operation of this air conditioner 1 will be described.

First, when the air conditioner 1 is operated in cooling mode, the four-way selector valve 12 is held in the state indicated by the solid lines in FIG. 1. High-temperature, high-pressure gaseous refrigerant discharged from the compressor 11 passes through the four-way selector valve 12 and into the outdoor heat exchanger 13, where it is condensed and changed to a liquid by exchanging heat with the outdoor air. The liquefied refrigerant passes through the fully opened outdoor expansion valve 14 and flows into each of the indoor units 3 via the liquid-side refrigerant communication pipe 17*b*. At each of the indoor units 3, the refrigerant is pressure-reduced by the indoor expansion valve 15 to a prescribed low pressure and evaporated in the indoor heat exchanger 16 by exchanging heat with the indoor air. Indoor air cooled by the evaporation of the refrigerant is blown into the indoor area by an indoor fan, not shown, so as to cool the indoor area. After being evaporated in the indoor heat exchanger 16, the gaseous refrigerant returns to the outdoor unit 2 through the gas-side refrigerant communication pipe 17*a* and is sucked into the compressor 11.

Meanwhile, when the air conditioner 1 is operated in heating mode, the four-way selector valve 12 is held in the state indicated by the broken lines in FIG. 1. High-temperature, high-pressure gaseous refrigerant discharged from the compressor 11 passes through the four-way selector valve 12 and into the indoor heat exchangers 16 of each of the indoor units 3, where it is condensed and changed to a liquid by exchanging heat with the indoor air. Indoor air heated by the condensation of the refrigerant is blown into the indoor area by an indoor fan so as to heat the indoor area. The refrigerant liquefied in the indoor heat exchangers 16 passes through the fully opened indoor expansion valves 15 and returns to the outdoor unit 2 via the liquid-side refrigerant communication pipe 17*b*. At the outdoor unit 2, the refrigerant is pressure-reduced by the outdoor expansion valve 14 to a prescribed low pressure and evaporated in the outdoor heat exchanger 13 by exchanging heat with the outdoor air. After being evaporated in the outdoor heat exchanger 13, the gaseous refrigerant passes through the four-way selector valve 12 and is sucked into the compressor 11.

During both cooling mode and heating mode, the indoor expansion valves 15 of indoor units 3 that are stopped are closed and hardly any refrigerant is sent to the indoor heat exchangers 16 of those indoor units 3.

<Constituent Features of the Outdoor Unit>

Next, the outdoor unit 2 will be described in details with reference to FIGS. 2 to 9. In addition, pipes and the like are omitted in FIGS. 3, 4, and 7 accordingly so that the explanation can be made easily.

Figure 3:
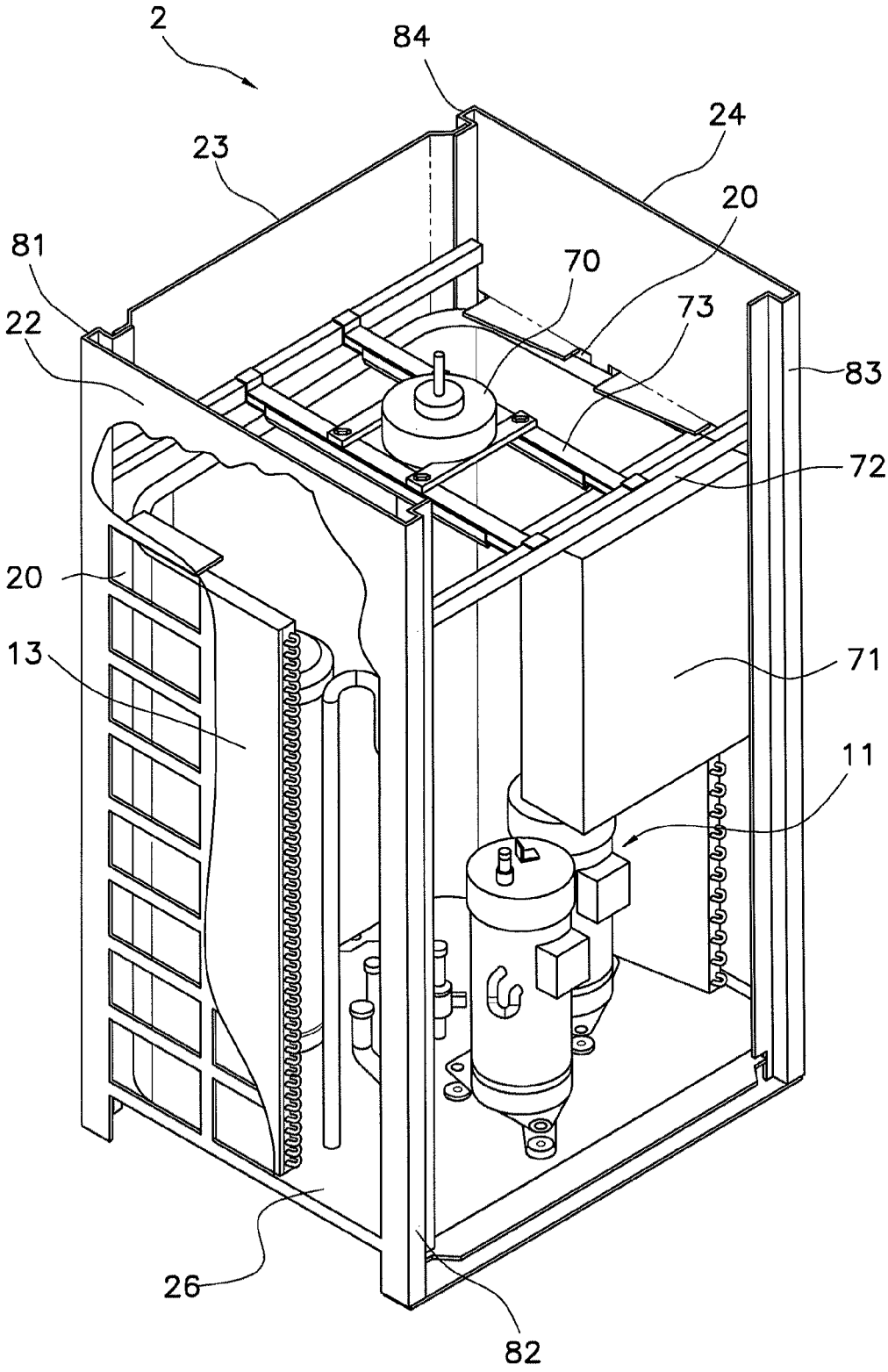
FIG. 3 is a perspective view of the outdoor unit with a portion of the casing and the outdoor fan removed.

FIG. 2 is an appearance diagram of the outdoor unit 2, and FIG. 3 is a perspective view of the outdoor unit 2 with a portion of the casing and the outdoor fan 29 removed. The shut-off valves 18, 19 and the shut-off valve mounting structure 27 are omitted in FIG. 3.

The left side panel 22 and the right side panel 24 of the casing are formed integrally with the support columns 81, 82, and 83, 84 respectively. Openings 20 are provided on the side panels 22, 24 for taking air into the interior of the casing of the outdoor unit 2. The rear panel 23 and the front panel 21 of the casing are mounted on the outside of the support columns 81, 84, and 82, 83 respectively. In addition, the four vertical support columns 81 to 84 are fastened together by a bottom frame 26 located near the bottom end of the columns 81 to 84, and a horizontal stays 72 and a motor support rack 73 located near the top portion of the columns 81 to 84. A motor 70 for driving the outdoor fan 29 is mounted to the motor support rack 73. The top panel 25 of the casing is fixed to the support columns 81 to 84 and to the side panels 22, 24 and the rear panel 23 on the outer edges thereof, and forms an air outlet of the outdoor unit 2 with a generally cylindrically shaped bell mouth 29*a* arranged around the impeller of the outdoor fan 29. A hole matching the bell mouth 29*a* is formed on this top panel 25, and a fan cover (not shown) of lattice-shaped soft steel wire is mounted to cover this hole. In addition, a switch box 71, with a control board for controlling the operation of the air conditioner 1 provided in the interior thereof, is arranged behind the front panel 21.

(Shut-Off Valves and Bottom Frame)

Figure 4:
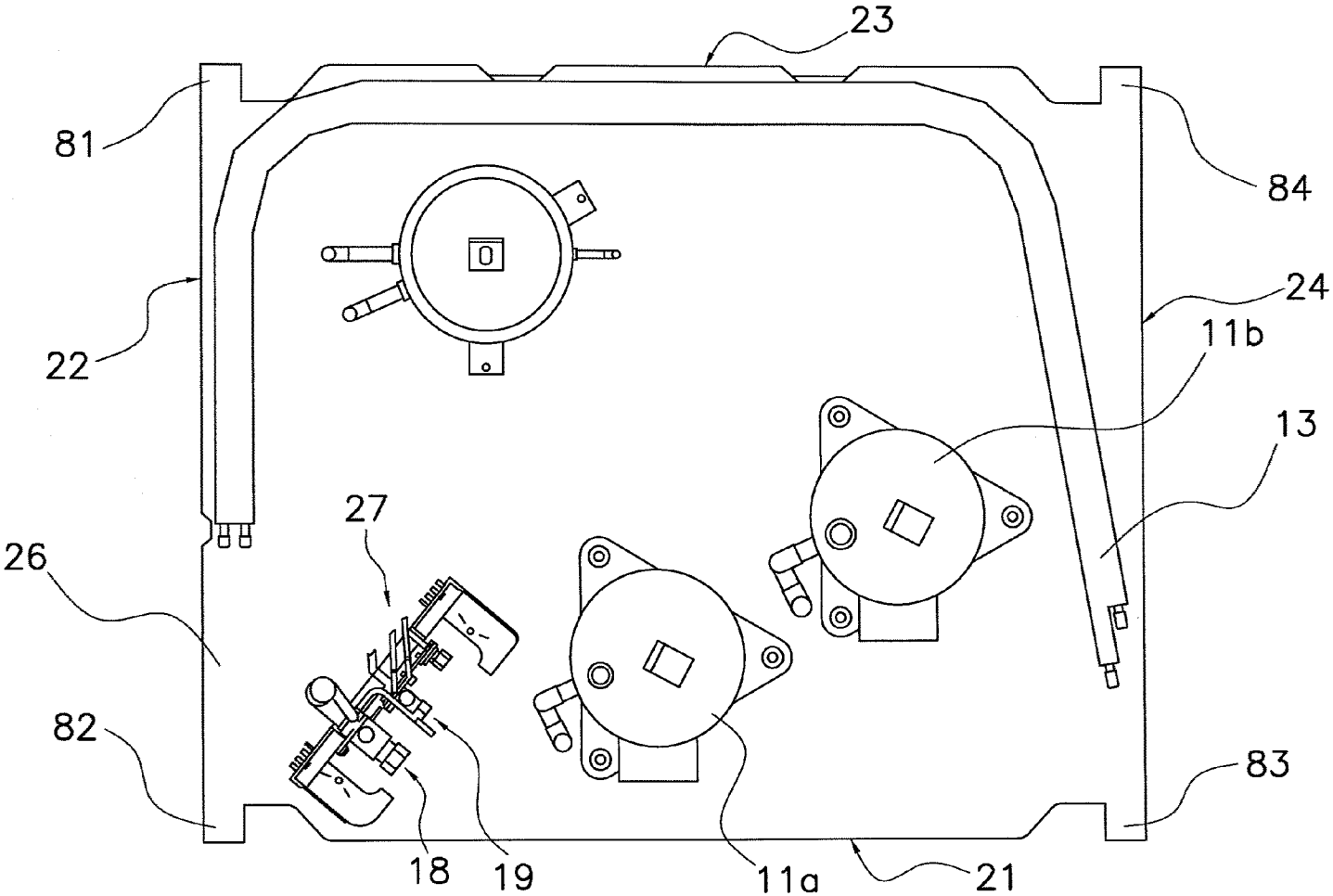
FIG. 4 is a plan view of an interior of the outdoor unit.

FIG. 4 is a plan view of the outdoor unit 2 when looked down from the middle in the heightwise direction. As shown, the bottom frame 26 functions to support the compressor 11, the outdoor heat exchanger 13, and the like, and also fasten the shut-off valves 18, 19 through the shut-off valve mounting structure 27. The gas-side shut-off valve 18 and the liquid-side shut-off valve 19 of the outdoor unit 2 are arranged adjacent to each other. The direction of arrangement of the gas-side shut-off valve 18 and the liquid-side shut-off valve 19 generally forms 45 degrees with respect to the front panel 21 and also with respect to the side panel 22 of the casing. That is, the gas-side shut-off valve 18 and the liquid-side shut-off valve 19 are arranged separately, and are offset in the widthwise direction (horizontal direction parallel to the front panel 21) and are also offset in the depth direction (horizontal direction parallel to the left side panel 22). For this reason, with these shut-off valves 18, 19, pipes can be easily drawn out from the front, back, and also left and right sides, and the racking operation of the refrigerant communication pipes 17*a*, 17*b* (wrapping thermally insulating tape around both pipes and/or covering them with a decorative metal plate) also becomes easy, while the thickness thereof is made thin, which improves the appearance.

Figure 5:
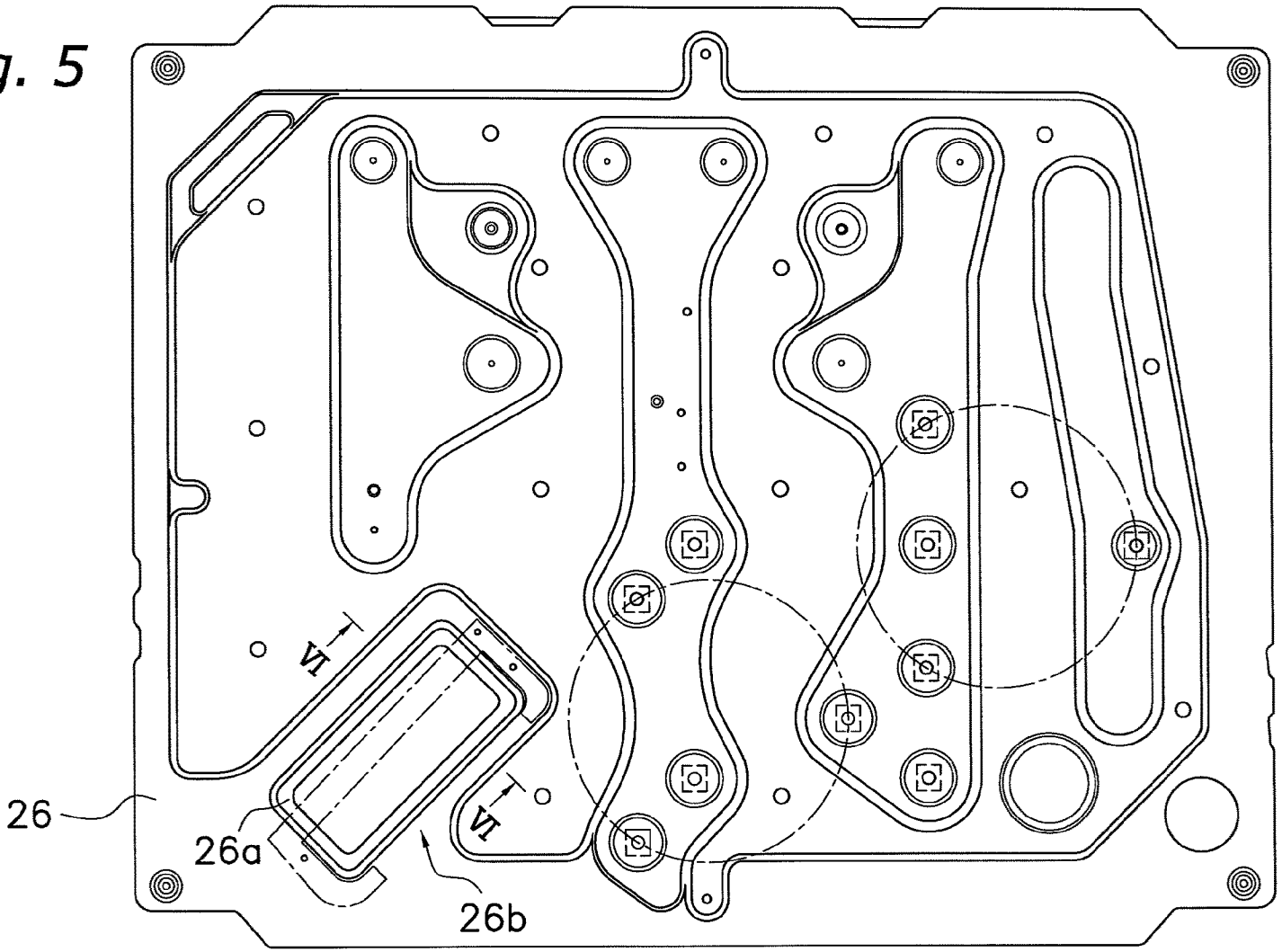
FIG. 5 is a plan view of a bottom frame of the outdoor unit.
Figure 6:
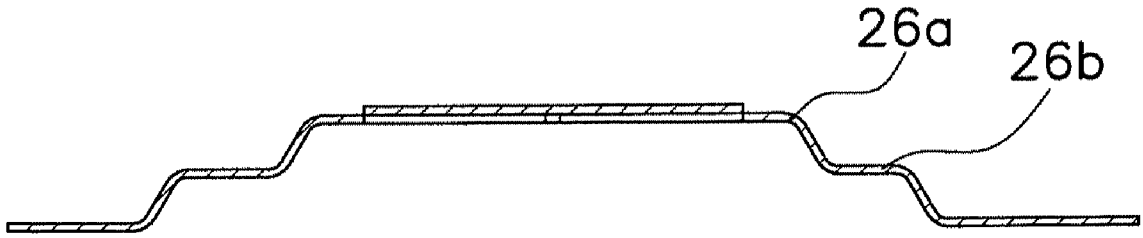
FIG. 6 is a section view taken at VI-VI in FIG. 5.

FIG. 5 is a plan view of the bottom frame 26, and FIG. 6 is a longitudinal section view taken at VI-VI shown in FIG. 5 of a protrusion 26*a* formed on the bottom frame 26. The mounting positions of the inverter compressor 11*a*, the fixed capacity compressor 11*b*, and the shut-off valve mounting structure 27 are shown by the dashed dotted lines in FIG. 5 for reference purpose. The surface of the bottom frame 26, including the protrusion 26*a*, has an uneven pattern for properly holding each member in place. The protrusion 26*a* protrudes inward inside the outdoor unit 2, or upwards, in a shape that is generally a rectangle with the four corners curved, to allow the shut-off valve mounting structure 27 to be easily positioned on the bottom frame 26. Furthermore, a region 26*b* surrounding this protrusion 26*a* is generally a horizontal surface.

(Shut-Off Valve Mounting Structure)

Figure 7:
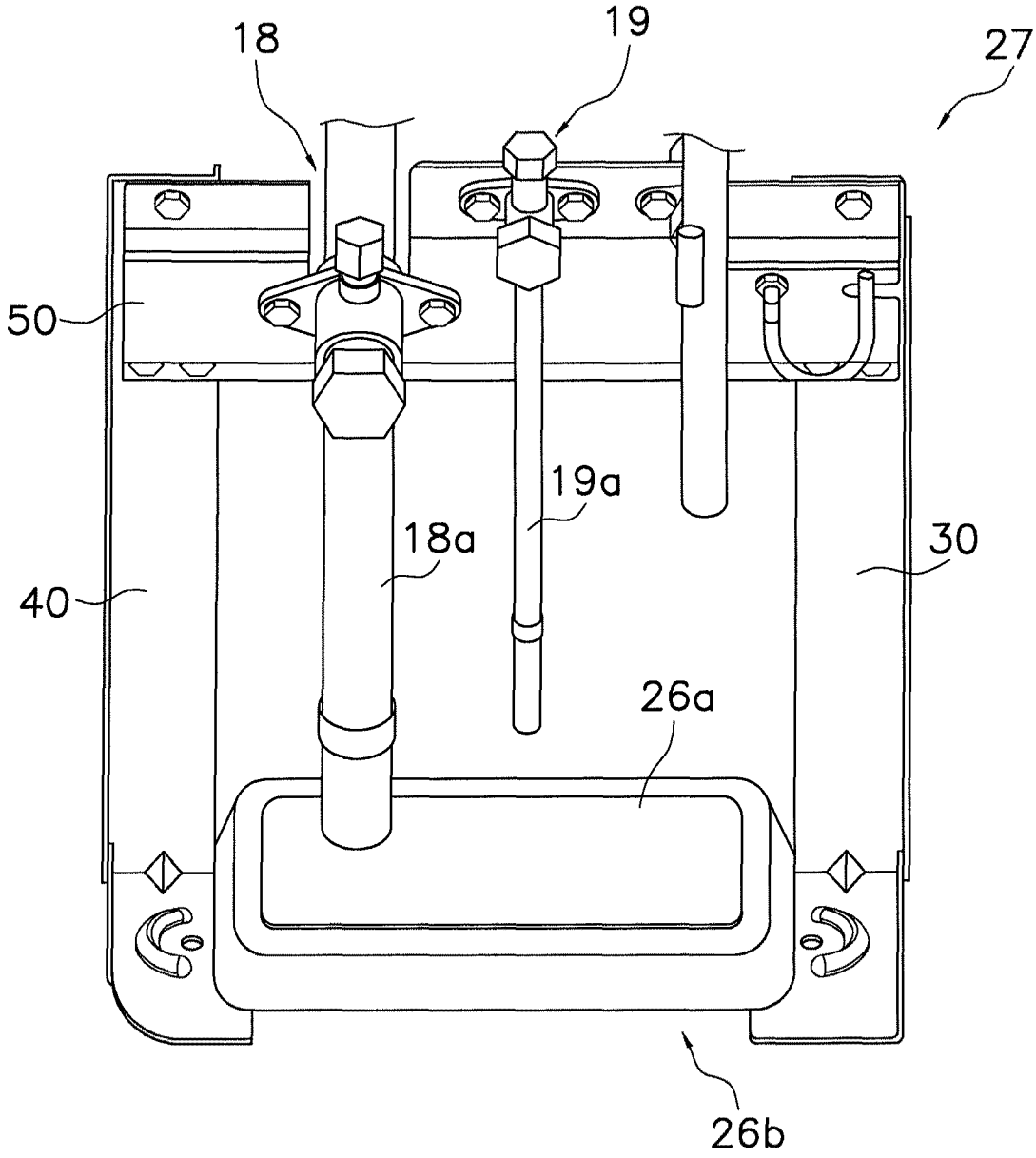
FIG. 7 is a diagram showing an area around a shut-off valve mounting structure.
Figure 8:
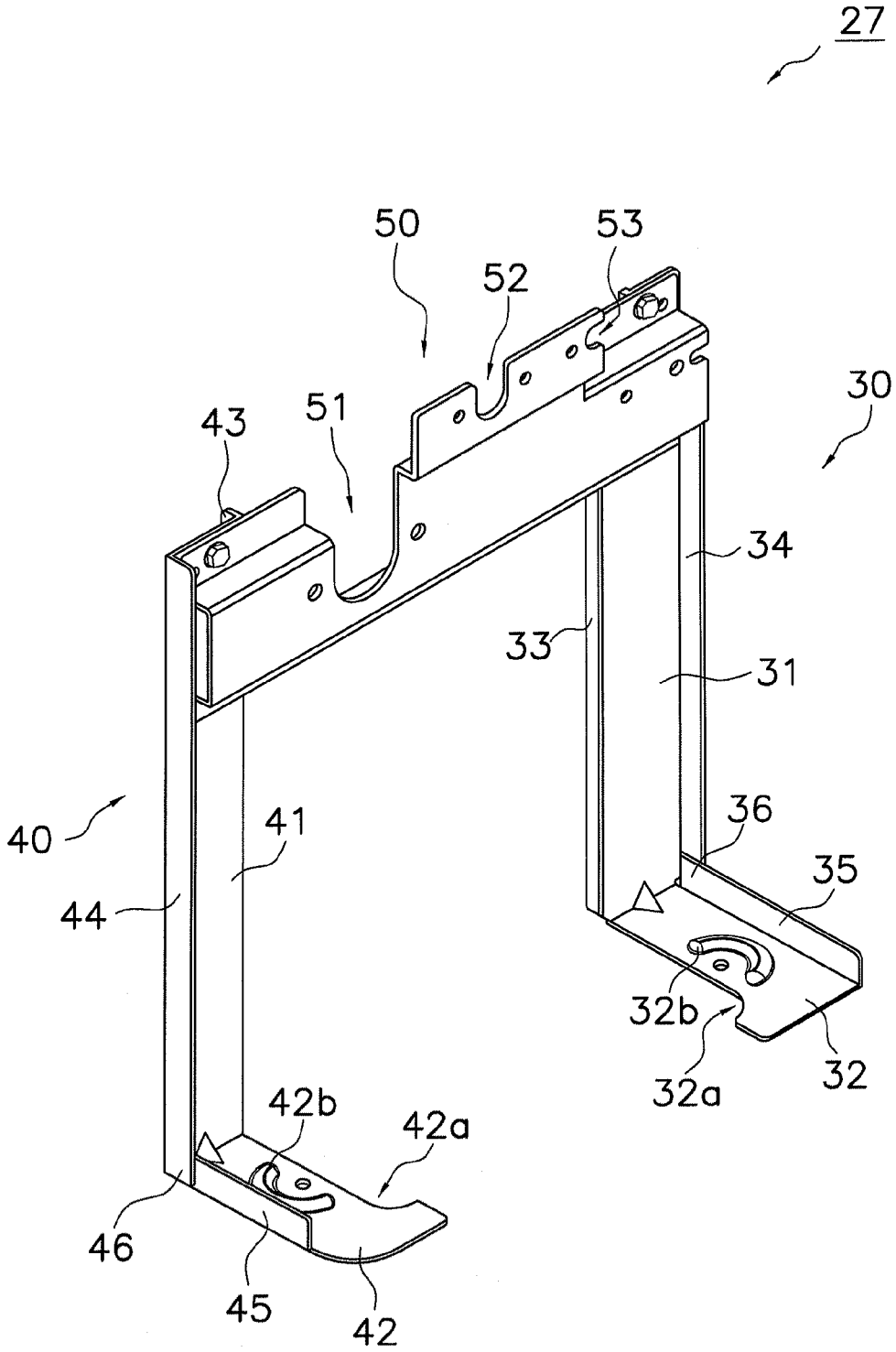
FIG. 8 is a perspective view of the shut-off valve mounting structure.
Figure 9:
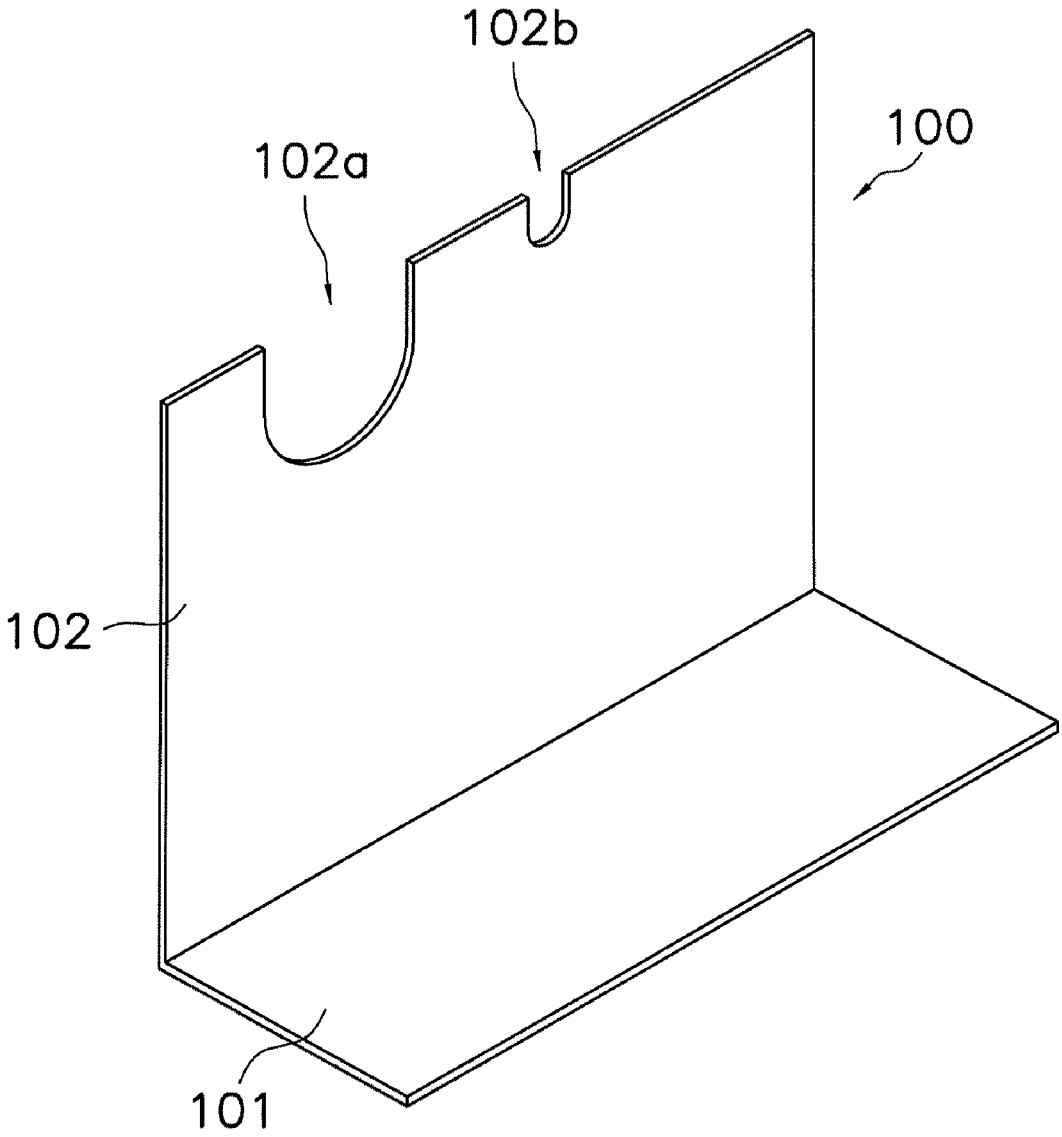
(Prior Art) Fig. 9
FIG. 9 is a perspective view of a conventional shut-off valve mounting structure.

FIG. 7 shows the area around the shut-off valve mounting structure 27 looked from above from the front side. FIG. 8 is a perspective view of the shut-off valve mounting structure 27.

The shut-off valve mounting structure 27 mainly includes a right-side base 30 positioned on the right side when looked from the front side, a left-side base 40 positioned on the left side when looked from the front side, and a fixing portion 50 that span over generally horizontally like a horizontal beam, connecting these bases 30, 40 near the upper ends thereof. The bases 30, 40 and the fixing portion 50 can be divided into three parts, but when they are being assembled together and fixed by screws and the like, they form a gate-like shape as shown in FIG. 8.

The right-side base 30 will now be described. Note that the following description can also be applied to the left-side base 40 by replacing numerals 30 through 36 with 40 through 46 respectively.

The right-side base 30 aligns with the protrusion 26*a* on the bottom frame 26, and stands on the region 26*b* of the bottom frame 26. The right-side base 30 mainly includes a main body 31, a bottom surface 32, a first side wall 33, a second side wall 34, and a third side wall 35, and is shaped by folding a sheet of metal plate cut to a prescribed shape.

The main body 31 is a flat vertical plate-like member extending generally vertically with the bottom end thereof connected to the bottom surface 32. The bottom surface 32 is a flat plate-like member expanding generally horizontally with the flat surface thereof in surface contact with the region 26*b* of the bottom frame 26 that expands approximately horizontally. A portion (engaging portion) 32*a* of the bottom surface 32 near the side of the left-side base 40 is curved around and fits with a part of the outline of the protrusion 26*a* and a corner of the protrusion 26*a* of the bottom frame 26. In addition, a hole is provided for passing a screw through to fasten the bottom surface 32 to the bottom frame 26 near the center of the bottom surface 32. Furthermore, a rib 32*b* is provided on a position on the bottom surface 32 as to surround the thread of the screw that passes through the above hole. Through this rib 32*b*, the shaking of the shut-off valve mounting structure 27 when the compressor 11 is operating can be kept to a minimum.

The first side wall 33 is a vertical plate-like member extending generally vertically and connects with the main body 31 on the side to the left-side base 40, and the flat surface of the first side wall 33 generally forms 90 degrees with respect to the main body 31. The second side wall 34 is a vertical plate-like member extending generally vertically and connects with the side away from the left-side base 40 of the main body 31, and the flat surface of the second side wall 34 forms generally 90 degrees with respect to the main body 31. In addition, the first side wall 33 and the bottom surface 32 are arranged on the opposite sides of the main body 31, and the second side wall 34 is arranged on the same side of the main body 31 as the bottom surface 32. The third side wall 35 is a vertical plate-like member extending generally horizontally and connects with the side away from the left-side base 40 of the bottom surface 32, and the flat surface of the third side wall 35 forms generally 90 degrees with respect to the bottom surface 32. The strength of the shut-off valve mounting structure 27 is improved with this kind of a folded structure of the right-side base 30 and the identical left-side base 40. Moreover, the overlapped portion 36 of the second side wall 34 and the third side wall 35 is spot-welded, which further strengthens the structure.

The fixing portion 50 will now be described.

The fixing portion 50 is shaped by folding a sheet of metal plate cut into a prescribed shape. The left and right end portions of the fixing portion 50 are fixed to the upper ends of the bases 30, 40 respectively by fastening members such as screws and the like, and the fixing portion 50 extends horizontally like a horizontal beam with the bases 30, 40 as its columns. Furthermore, for strengthening purpose, the fixing portion 50 is folded four times at generally 90 degrees with the vertical section thereof visually in a mountain-like shape, or stepped.

In addition, incisions 51, 52 are formed to be generally semicircular, along the upper end of the fixing portion 50. The radius of the incision 51 is greater than the radius of the incision 52, and the gas-side shut-off valve 18 and the liquid-side shut-off valve 19 are inserted in the incisions 51, 52 respectively and held in place. Furthermore, an incision 53 is formed generally semicircular on the fixing portion 50 for receiving in and holding a refrigerant supplying port in place.

Both the pipe connecting port 18*a* of the gas-side shut-off valve 18 and the pipe connecting port 19*a* of the liquid-side shut-off valve 19 face downward. These shut-off valves 18, 19 are connected to the refrigerant communication pipes 17*a*, 17*b* by brazing, instead of a structure of being connected to the refrigerant communication pipes 17*a*, 17*b* by flare nuts or flanges. This makes the connection operation of the shut-off valves 18, 19 and the refrigerant communication pipes 17*a*, 17*b* onsite easier, without having to fasten screws, and also reduces the risk of the leakage of refrigerant.

<Characteristics>

(1)

This shut-off valve mounting structure 27 is in a gate-like shape, mainly including the two column-shaped bases 30, 40, and the fixing portion 50, like a horizontal beam, suspended over these bases 30, 40, and below where the shut-off valves 18, 19 are fixed is an open space. That is, a working space for connecting the shut-off valves 18, 19 and the refrigerant communication pipes 17*a*, 17*b* onsite is being secured. Consequently, not only the connecting between the shut-off valves 18, 19 and the refrigerant communication pipes 17*a*, 17*b* becomes easier in the outdoor unit 2, but also it is easier to operate on the other members arranged in the area around the shut-off valve mounting structure 27. For example, when the connection is done by brazing, a burner used for brazing can be arranged in this open space. In addition, in this case, it becomes easier to avoid problems such as the flame from the burner and the like accidentally burning the shut-off valve mounting structure 27.

In addition, by having this space, other members such as pipes and the like can be arranged in the vicinity of the shut-off valve mounting structure 27 by passing through this gateway, and this increases the freedom in the arrangement of members in the design of the outdoor unit 2. Furthermore, the cost of materials can be reduced compared to if a conventional plate-like member is used.

(2)

The two column shaped bases 30, 40 and the horizontal beam-like fixing portion 50 are separate bodies in this shut-off valve mounting structure 27, and these members 30, 40, 50 are combined to form the shut-off valve mounting structure 27. For this reason, the bases 30, 40 can be used for any type of a plurality of outdoor units having different numbers and sizes of shut-off valves, while only the fixing portion 50 is made to correspond to the configuration of the pipes of different models, and this can reduce the cost when new models of air conditioners are developed, such as by reducing the cost of molds. For example, a fixing portion corresponding to a model of a cooling/heating free air conditioner is formed by arranging another incision capable of supporting an exclusive part on the right side of the incision 52 when looked from the front side on the fixing portion 50 of this embodiment.

In addition, cutting layouts for the bases 30, 40, and the fixing portion 50 can be created more efficiently during the time of manufacturing, and the cost of materials can be reduced.

(3)

The protrusion 26*a* is formed protruding upwards on the surface of the bottom frame 26 of this outdoor unit 2. Portions 32*a*, 42*a* of the bases 30, 40 of the shut-off valve mounting structure 27 are arranged on positions so as to fit with a part of the outline of this protrusion 26*a*. That is, since the protrusion 26*a* of the bottom frame 26 and the portions 32*a*, 42*a* of the bases 30, 40 of the shut-off valve mounting structure 27 are shaped to be able to fit with each other in this outdoor unit 2, the positioning of the shut-off valve mounting structure 27 on the bottom frame 26 can be done easily.

Furthermore, since this makes it easy to fix the shut-off valve mounting structure 27 on the bottom frame 26, the number of fastening members can be reduced.

MODIFICATION EXAMPLE

In the above described embodiment, although the shut-off valve mounting structure 27 is in a gate-like shape, the present invention is not limited to this. For example, the shut-off valve mounting structure may be in an L-letter shape or a T-letter shape having one column shaped base and a horizontal beam-like fixing portion supported on this base.

Industrial Applicability

This invention is useful in providing a shut-off valve mounting structure for fixing shut-off valve in an outdoor unit of an air conditioner and an outdoor unit of an air conditioner having the same, for improving the workability in which a shut-off valve and a refrigerant communication pipe are connected in an outdoor unit of an air conditioner.

What is claimed is:

1. An outdoor unit of an air conditioner, comprising:

a casing including a bottom frame;

a shut-off valve connected to an indoor unit via a refrigerant communication pipe; and a shut-off valve mounting structure holding the shut-off valve place, the shut-off valve mounting structure including a base including two column shaped members extending upwards from the bottom frame; and a fixing portion connected to both of the two column shaped member with the shut-off valve being supported in place by the fixing portion, the base being a member configured only to fix the fixing portion to the bottom frame, the shut-off valve being connected to the refrigerant communication pipe by brazing, a space being formed laterally between the two column shaped members overall, upwardly of the bottom frame and below the fixing portion, and the base including an engaging portion engaging at least a portion of an outline of a protrusion protruding inwardly from the bottom frame towards an inside of the outdoor unit.

2. The outdoor unit according to claim 1, wherein the shut-off valve includes a gas-side shut-off valve and a liquid-side shut-off valve, and the gas-side shut-off valve and the liquid-side shut-off valve are offset in the depth direction so that the gas-side shut-off valve is positioned more to a front side than the liquid-side shut-off valve when viewed in plan.

3. The outdoor unit according to claim 1, wherein the base and the fixing portion are connected together in a detachable and reattachable manner.

* * * * *

UNITED STATES PATENT AND TRADEMARK OFFICE

CERTIFICATE OF CORRECTION

PATENT NO. : 8,297,071 B2
APPLICATION NO. : 12/090504
DATED : October 30, 2012
INVENTOR(S) : Kazuhiro Shioyama et al.

It is certified that error appears in the above-identified patent and that said Letters Patent is hereby corrected as shown below:

Column 11,
Line 10, "valve place, the shut-off valve mounting structure" should read -- valve in place, the shut-off valve mounting structure --.

Column 11,
Line 15, "shaped member with the shut-off valve being sup-" should read -- shaped members with the shut-off valve being sup- --.

Signed and Sealed this
Nineteenth Day of March, 2013

Teresa Stanek Rea
*Acting Director of the United States Patent and Trademark Office*